United States Patent [19]

Lockwood

[11] Patent Number: 4,495,717

[45] Date of Patent: Jan. 29, 1985

[54] COMBINATION SPACER AND LIFTING DEVICE FOR BACKHOE MACHINERY

[76] Inventor: Michael Lockwood, 623 1/3 E. Haley St., Santa Barbara, Calif. 93103

[21] Appl. No.: 454,661

[22] Filed: Dec. 30, 1982

[51] Int. Cl.[3] ..... E02F 3/76

[52] U.S. Cl. ..... 37/117.5; 37/DIG. 3; 37/DIG. 12; 414/724; 414/912

[58] Field of Search ..... 37/117.5, DIG. 3, DIG. 12; 414/722, 724, 912; 294/82 R

[56] References Cited

U.S. PATENT DOCUMENTS

| | | | |
|---|---|---|---|
| 2,402,352 | 6/1946 | Taylor | 37/DIG. 3 |
| 2,515,571 | 7/1950 | Siler | 294/82 R X |
| 3,501,817 | 3/1970 | Bambenek et al. | 294/82 R X |
| 3,587,887 | 6/1971 | De Carli | 414/724 X |
| 3,596,996 | 8/1971 | Carter | 37/117.5 X |
| 3,702,712 | 11/1972 | Cairns | 37/117.5 X |
| 4,204,348 | 5/1980 | Lydie | 37/117.5 |
| 4,242,035 | 12/1980 | Hornstein | 37/117.5 X |
| 4,320,561 | 3/1982 | Müller et al. | 294/82 R X |

FOREIGN PATENT DOCUMENTS

| | | | |
|---|---|---|---|
| 2514070 | 11/1975 | Fed. Rep. of Germany | 37/117.5 |
| 711239 | 1/1980 | U.S.S.R. | 414/724 |

*Primary Examiner*—Edgar S. Burr
*Assistant Examiner*—Moshe I. Cohen
*Attorney, Agent, or Firm*—William W. Haefliger

[57] ABSTRACT

A combination spacer and lifting device for backhoe machinery, wherein the device includes a spacer defined by an elongated tubular sleeve member which is formed having an extended tab member fixedly attached thereto. The sleeve member is positioned as a spacer between the hydraulic-cylinder link members, and is rotatably mounted on the link pin which pivotally connects the link members to the bucket of the backhoe. A hook member is pivotally connected by a release pin to the extended tab member of the sleeve, providing a means by which a chain, cable or the like can be readily attached so as to carry or lift a given load or structure.

3 Claims, 3 Drawing Figures

FIG. 1
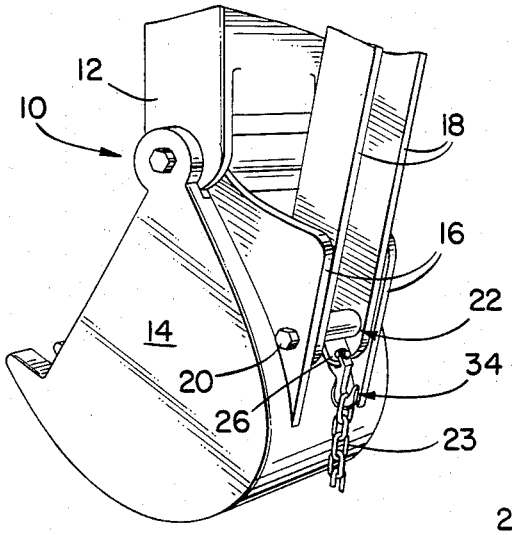
FIG. 2
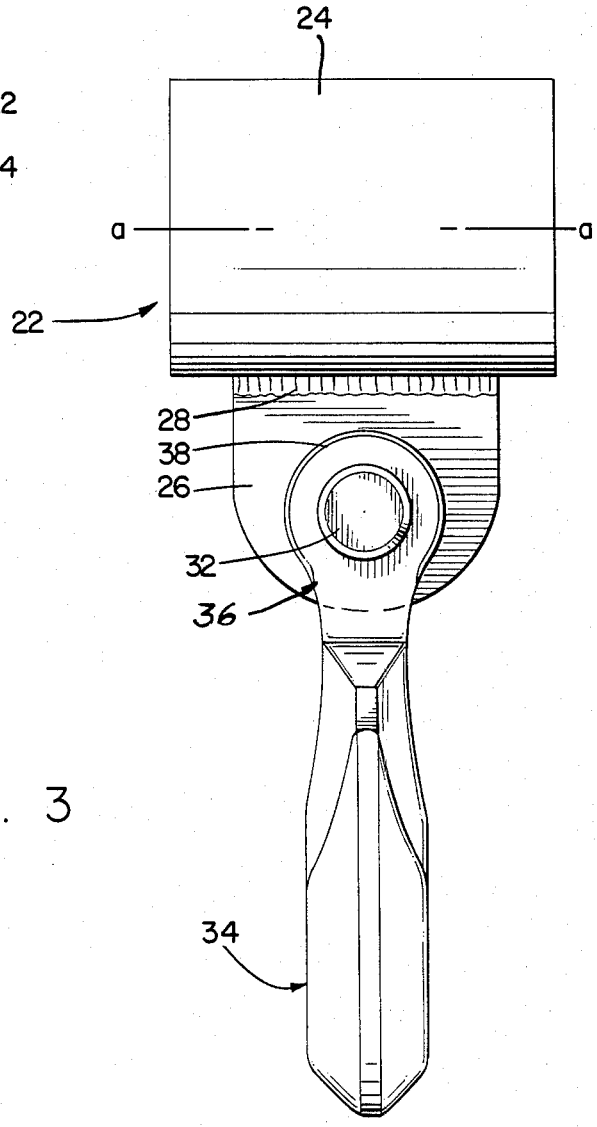
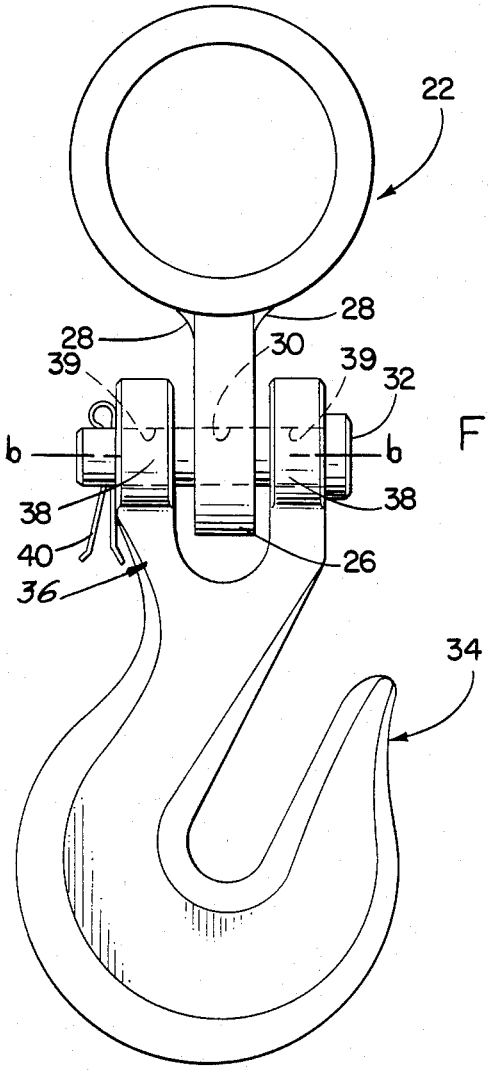
FIG. 3

COMBINATION SPACER AND LIFTING DEVICE FOR BACKHOE MACHINERY

BACKGROUND OF THE INVENTION

1. Field of the Invention

This invention relates generally to a lifting device, and more particularly to a combination spacer and lifting device for use with a backhoe having a typical bucket.

2. Description of the Prior Art

As is well known in the art, various problems and difficulties are being encountered in providing suitable means for using a backhoe machine as a lifting device for an on-the-job crane mechanism. That is, very often there is a need to lift or move a load or structure where only a backhoe device is available. The backhoe is mainly designed to dig trenches and to perform like operations by means of a hydraulically operated bucket which is generally provided with digging teeth along the leading edge thereof. These teeth have been used to lift loads or structures, but in many cases with very limited success. Chains and cables are sometimes employed by wrapping them around the bucket, and this has not produced the best results.

Accordingly, there is a need for a lifting device that can be simply attached to a backhoe unit without requiring changes to the backhoe or the bucket, and can be left in place as a functional part of the machine.

SUMMARY AND OBJECTS OF THE INVENTION

The present invention has for an important object to provide a lifting device that can be simply and effectively attached to most backhoe units, so as to overcome all of the presently known problems associated with lifting loads or structures with the aid of a backhoe unit.

It is another object of the invention to provide a combination spacer and lifting device which is readily positioned between the hydraulic-cylinder link bars, and is adapted to be rotatably mounted to the link pin that connects the links with the bucket, thus becoming an integral part of the backhoe.

It is still another object of the invention to provide a combination spacer and lifting device that allows a backhoe unit to function in a fashion that is similar to that of a hydraulic crane.

It is a further object of the invention to provide a device of this type that comprises a cylindrical sleeve member which is formed with an extended tab to which a hook member is releasably attached whereby chains, cables and like attachments can be used.

A still further object of the present invention is to provide a device of this character that has relatively few operating parts, is easy to service and maintain, and is relatively inexpensive to manufacture.

Still a further object of the invention is to provide a device of this character that is simple and rugged in construction, yet accomplishes the desired results of a lifting device.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a pictorial view of a backhoe bucket illustrating the present invention being mounted between the hydraulic-cylinder links of the backhoe unit;

FIG. 2 is an enlarged front-elevational view of the lifting device; and

FIG. 3 is a side-elevational view thereof.

DESCRIPTION OF THE PREFERRED EMBODIMENT

Referring more particularly to FIG. 1, there is shown a portion of a backhoe unit, generally indicated at 10. The portion illustrated includes the main supporting strut boom or arm 12 having a typical backhoe bucket 14 pivotally connected thereto. The bucket 14 is commonly provided with extended mounting plates 16 to which are pivotally connected a pair of hydraulic link bars 18. These bars are attached at their opposite ends to a hydraulic cylinder (not shown).

A pivot pin 20 of any suitable type is mounted so as to pass through plates 16 and link bars 18, a spacer member being generally positioned between the two opposing link bars.

Accordingly, in the practice of the present invention the normal spacer (not shown) is removed, and a combination spacer and lifting device, designated generally at 22, is inserted in place thereof, as seen in FIG. 1. Thus, such a device will enable the backhoe unit to be used in a manner similar to that of a hydraulic crane, whereby chains 23, cables, or like supporting devices, can be readily attached for moving or lifting loads or structures.

The present invention comprises a tubular sleeve or cylinder 24 having a wall structure of hardened steel of between $\frac{3}{8}''$ to $\frac{1}{2}''$ thick. The length of the sleeve should be determined by the space between the opposing link bars 18. Secured to sleeve 24 is a tab member 26. The tab can be secured in a suitable manner, either by welding as indicated at 28 or by forming the sleeve and tab as an integral unit such as by casting.

Tab 26 is preferably mounted longitudinally along the sleeve having a hole 30 disposed therein to receive mounting pin 32 which is used to mount and support a clevis-style hook 34. Hook 34 includes a yoke section 36, each yoke arm 38 having aligned holes 39. Thus, the yoke arms are arranged to straddle tab member 26, the pin 32 being secured by a cotter pin 40 in a well known manner.

Moreover, it is important to note the universal interconnection between the hook 34 and bucket 14, whereby sleeve 24 is adapted to rotate about the lateral axis a—a, as indicated in FIG. 2, and hook member 34 is adapted to rotate about the transverse axis b—b of mounting pin 32, as indicated in FIG. 3. This movement allows any imbalance to be corrected while a load is being raised.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

As is clear from the drawings, the chain 23 engages the hook to be carried to hang downwardly to freely and variably engage said bucket around surface as the bucket is lifted and lowered by said arm supporting the bucket.

I claim:

1. In combination (a) an arm supported backhoe bucket having two laterally spaced protruding plates which extend in vertical planes, said bucket having an outer surface which is convexly curved downwardly, and from a location between said plates, (b) a tubular sleeve extending laterally and having a lateral axis and confined endwise between said flanges, and a pin extending laterally through the sleeve and carried by the plates so that the sleeve may rotate about the pin, (c) a tab integral with the sleeve and extending downwardly therefrom, outwardly of said bucket surface, (d) a hook having a stem pivotally attached to said tab to hang downwardly outwardly of but close to the bucket surface between said plates, (e) a chain having a link engaging and carried by said hook, the chain extending downwardly to freely and variably engage said bucket curved surface as the bucket is lifted and lowered by said arm supporting the bucket, (f) the stem having two upwardly projecting yoke arms forming a space therebetween, the tab projecting downwardly in a plane which is normal to said plates to extend between the yoke arms for pivotal connection therewith and about an axis which extends forwardly from the bucket surface, a vertical plane through said forward axis extending normal to the lateral axis of the sleeve.

2. The combination of claim 1 wherein the hook stem is located between said plates whereby the chain is engaged with the bucket surface proximate said plates.

3. The combination of claim 2 wherein said yoke arms and tab form aligned openings, and including a pivot pin extending laterally through said openings to define a pivot axis parallel to said lateral axis of the sleeve.

* * * * *